United States Patent [19]

Morrill, Jr.

[11] 3,938,066

[45] Feb. 10, 1976

[54] REED SWITCHES AND PROCESS FOR MAKING THEM

[75] Inventor: Vaughan Morrill, Jr., St. Louis, Mo.

[73] Assignee: Morex, Inc., St. Louis, Mo.

[22] Filed: July 8, 1974

[21] Appl. No.: 486,452

[52] U.S. Cl. ..... 335/154; 29/622; 335/151

[51] Int. Cl.[2] ..... H01H 1/66; H01H 51/28

[58] Field of Search ..... 335/151, 152, 153, 154; 29/622

[56] References Cited

UNITED STATES PATENTS

| | | | |
|---|---|---|---|
| 3,240,897 | 3/1966 | Anderson et al. | 335/154 |
| 3,345,593 | 10/1967 | Grengg | 335/154 |
| 3,349,352 | 10/1967 | Zandt | 335/154 |
| 3,794,944 | 2/1974 | Morrill, Jr. | 335/154 |

FOREIGN PATENTS OR APPLICATIONS

| | | | |
|---|---|---|---|
| 1,133,745 | 11/1968 | United Kingdom | 335/151 |

*Primary Examiner*—Harold Broome
*Attorney, Agent, or Firm*—Polster and Polster

[57] ABSTRACT

A reed switch is made by forming an envelope tube, non-circular in cross-section, with a known internal heightwise dimension, forming a reed element with two end-bearing portions at least one of which is part of a contact section of the reed element and an intermediate sealing-bearing section between and entirely out of a plane defined by the end-bearing portions of the reed, the distance between the plane and a bearing surface of the sealing-bearing section being greater than the internal heightwise dimension of the envelope tube; inserting the reed element into an open end of the envelope tube sufficiently far to cause both of the end-bearing portions and the bearing surface of the sealing-bearing section to bear against the inside wall of the envelope tube, the end-bearing portion of the contact section of the reed element bearing with a force greater than the force ultimately to be exerted by that portion in the finished switch; sealing at least a part of the sealing section in the envelope tube to seal said tube and form the reed switch envelope, and relieving at least a part of the pressure exerted upon the inside wall by the end-bearing portion of the contact section of the reed.

The resulting reed switch has at least one reed element with two end-bearing portions bearing upon undistorted areas of the inside wall of the envelope and a sealing section sealed in the envelope, the force with which the end portion of the contact section or sections bears against the envelope wall being less than the force with which it bore during the reed switch forming process.

12 Claims, 10 Drawing Figures

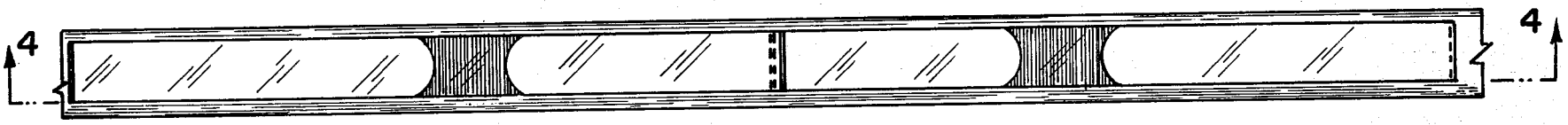
FIG. 3.
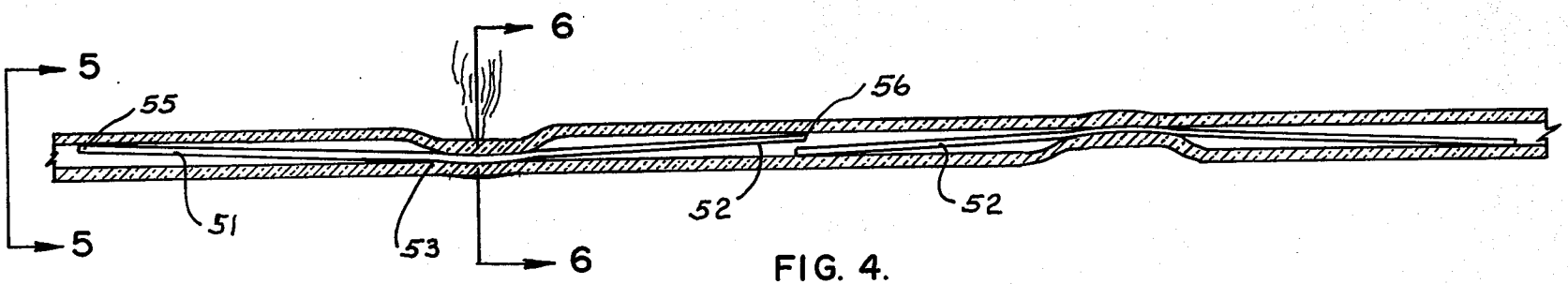
FIG. 4.
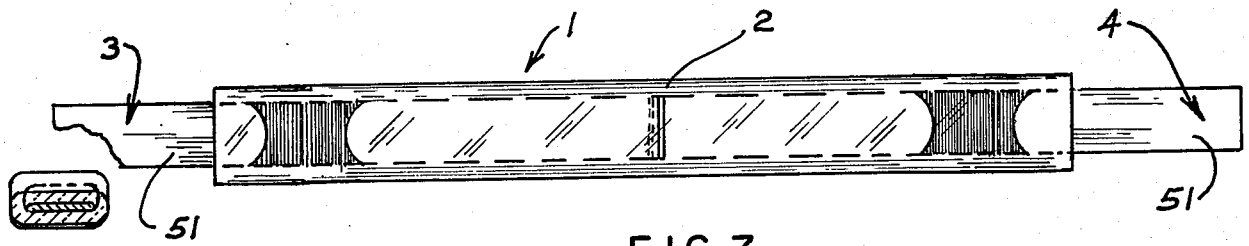
FIG. 7.
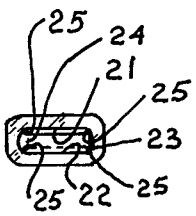
FIG. 6.
FIG. 5.
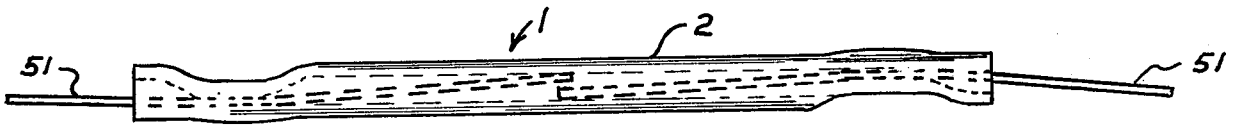
FIG. 8.

REED SWITCHES AND PROCESS FOR MAKING THEM

RELATED APPLICATIONS

The subject matter of the present application is related to that of my co-pending U.S. application Ser. No. 400,796, and of its parent application Ser. No. 290,113 now U.S. Pat. No. 3,794,944 and, as to common subject matter, the present application, is a continuation-in-part thereof.

BACKGROUND OF THE INVENTION

The state of the art in the manufacture of reed switches before my inventions therein is described in my U.S. Pat. No. 3,794,944.

In that patent, I have disclosed a new reed switch in which the envelope is made non-circular in cross section and a reed is so formed as to permit it to constitute the sole means of positioning it in five of the six possible degrees of freedom while it is being sealed into its envelope.

The reed elements of the two-element reed switches described in U.S. Pat. No. 3,794,944 are made with a sealing section with an effective cross-sectional configuration complementary to and dimensioned to fit closely the noncircular envelope, and of greater cross-sectional area than that of the reed or contact section. This has required special forming of the reed elements. To maintain the position and orientation of the elements during manufacture of glass-envelope switches, it has been necessary to have a sealing section of a length to bear on unsoftened glass throughout the sealing step.

The present invention relates to a reed switch and method of making it, by which a reed element (or, in the usual case, each of a plurality of reed elements) and an envelope tube can be used to serve as the sole means for holding the reed element against movement in all six possible degrees of freedom, of using the dimensions of the envelope tube and reed element precisely to determine the gap between the contact areas of overlapping reed elements, and to produce a predetermined desired pressure of the end-bearing portion of the contact section of the reed element against the envelope wall to minimize bounce and flagging of th he reed contact, by utilizing the springiness of the reed element itself.

BRIEF SUMMARY OF THE INVENTION

In accordance with this invention generally stated, a reed switch is provided with a reed element having two end-bearing portions, at least one of which is part of a contact section, and an intermediate sealing-bearing section, all within an envelope, the end-bearing portions bearing upon an undistorted part of the inside wall of the envelope and the sealing-bearing section being sealed in and to the envelope. In the finished switch, a part of the envelope surrounding an outer, lead, section of which one end-bearing portion is a part may be removed, to expose the lead section. In forming the reed switch of this invention, an envelope tube is formed, non-circular in cross-section, with a known internal heightwise dimension uniform throughout its envelope-forming length. A reed element is formed with two end-bearing portions and an intermediate sealing-bearing section between and entirely out of a plane defined by the opposite end-bearing portions of the reed element. The distance between the plane and a bearing surface of the sealing-bearing section is greater than the internal heightwise dimension of the envelope tube. The reed is forced into an open end of the envelope sufficiently far to cause both of the end portions and the bearing surface of the sealing-bearing section to bear against the inside wall of the envelope tube, the contact end-bearing portion of the reed bearing with a force greater than the force ultimately to be exerted by that portion in the finished switch. At least a part of the sealing-bearing section is then sealed in what becomes the envelope and the pressure exerted by the end-bearing portion of the contact section of the reed element is relieved, at least in part. In the preferred embodiment, the envelope tube is made of glass and is of substantially uniform, generally rectangular internal cross section. The reed element is of substantially uniform rectangular cross sectional configuration, of a width to fit slidably but closely within a widthwise internal dimension of the envelope tube, of a thickness less than half the heightwise internal dimension of the envelope tube, and of a length less than the length of the envelope tube. The reed element is bent intermediate its ends beyond the memory of the reed element to form the sealing-bearing section. After the formed reed element is inserted in the envelope tube, the glass of the envelope tube is softened in the area of the sealing-bearing section of the reed element until the reed is sealed in the envelope, while at the same time, the sealing-bearing section moves a part of the softened envelope tube away from the plane defined by the end-bearing portions of the reed and relieves at least part of the bearing force of the inner end-bearing portion of the reed. Either in lieu of the displacement of glass by the sealing-bearing section of the reed, or supplementary thereto, the reed between the sealing-bearing section and the inner contact portion of the reed can be heated to relieve the bearing force, as by a finely focused laser beam. In those embodiments in which in-line series-connected switches are formed in a single envelope, intermediate reed elements may have two contact sections rather than a lead and a contact section.

In the preferred embodiment, the springiness of the reed element not only serves to hold the reed element against lengthwise translation during the sealing process, but serves to provide an automatic pressure adjusting means when the glass is softened. The bearing of the contact section end-bearing portion on the inner wall of the envelope minimizes flagging and bounce of the contact sections of the switch.

In the description heretofore and to follow, the terms "heightwise" and "widthwise" are used only as a matter of convenience and clarity as applied to the drawings. Since the reed elements will hold themselves in position during the inserting and sealing steps of their manufacture, the envelope tube can be oriented in any possible attitude during those steps.

One of the objects of this invention is to provide a reed switch which is easy and economical to make, uniformly accurate and reliable, and in which bounce and flagging are minimized.

Other objects will become apparent to those skilled in the art in the light of the following description and accompanying drawings.

BRIEF DESCRIPTION OF THE DRAWINGS

In the drawing.

FIG. 3 is a top plan view, much enlarged, of a reed switch of this invention, just after the reed elements have been sealed into the envelope;

FIG. 4 is a sectional view taken along the line 4—4 of FIG. 3;

FIG. 5 is a view in end elevation, viewed from the line 5—5 of FIG. 4;

FIG. 6 is a sectional view taken along the line 6—6 of FIG. 4;

FIG. 7 is a top plan view of a reed switch of the same construction as FIG. 3, with an outside portion at each end of the envelope removed to expose outer lead portions of the reed elements;

FIG. 8 is a view in side elevation of the reed switch of FIG. 7;

DETAILED DESCRIPTION OF THE DRAWINGS

Figure 2:
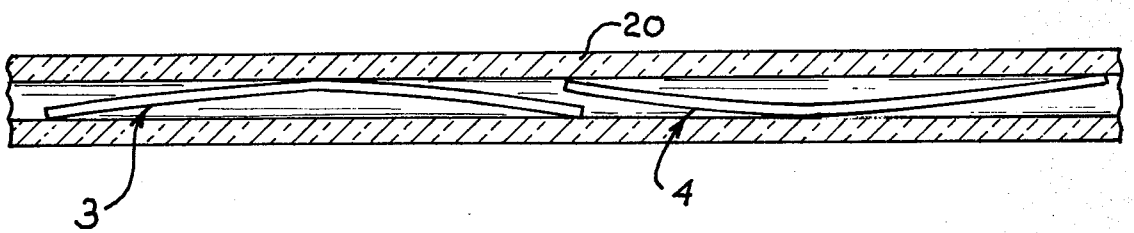
FIG. 2 is a lengthwise sectional view, much enlarged, of one embodiment of envelope tube of this invention, in which the reed element shown in FIG. 1 has been inserted, and also another, identical, reed element, rotated 180° about a long axis from the other.

Referring now to the drawings and particularly FIGS. 1–8 for one illustrative embodiment of this invention, reference numeral 1, FIGS. 7 and 8, indicates a completed reed switch, with an envelope 2 and reed elements 3 and 4. Except in a distorted sealing area, the envelope 2 is generally rectangular in cross section, as shown particularly in FIG. 5, with a widthwise dimension greater than a heightwise dimension, to provide broad upper and lower inside surfaces 21 and 22, relatively narrow heightwise inside surfaces 23 and 24, and somewhat rounded or chamfered concaves or fillets 25 between them. In practice, the heightwise inside surfaces are slightly bowed outwardly, as shown somewhat exaggeratedly in FIGS. 5 and 6.

The reed elements 3 and 4 are identical, but rotated 180° from one another about their long center axis. Each of the reed elements in this embodiment is rectangular in cross-section, with a chamfer or radius at each long edge corresponding complementarily to the chamfer or radius of the fillets 25, and has a lead or outer section 51, a contact or inner section 52, and a sealing-bearing section 53. In the embodiments shown, an outer end bearing portion 55 consists of an edge of the end of the outer section 51. An inner endbearing portion 56 of the inner end section of the reed consists of an edge of the inner end of the inner section 52. The sealing-bearing section 53 has a bearing portion or surface 54. The bearing portions 55 and 56 are parallel and make line contact with the broad surface 22 when both bearing surfaces are within the envelope. If one end were canted slightly with respect to the other, three points or a point and a line of the bearing portions 55 and 56 would nevertheless define a plane of reference.

The sealing-bearing section 53 is entirely out of that plane of reference before the reed element is inserted in the envelope.

The envelope 2 is formed from tube 20, of uniform internal dimensions through its envelope-forming length. It is open at at least one end which may be flared to facilitate insertion of the reed elements.

Figure 9:
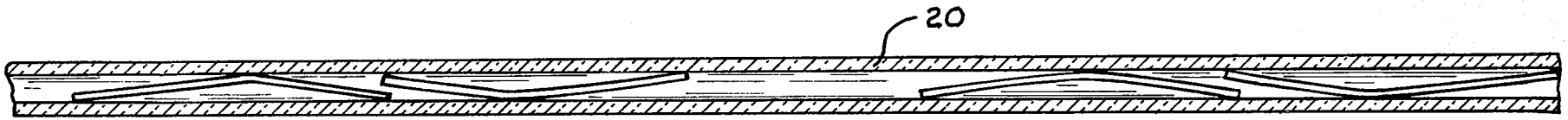
FIG. 9 is a lengthwise sectional view showing a plurality of reed elements in an envelope tube before sealing to form a plurality of reed switches each with two reed elements.

In the preferred embodiment of manufacture of the reed switch 1, the tube 20 of glass is long enough to accomodate a multiplicity of pairs of reed elements. In FIG. 9, two of a larger number of pairs are shown. The reed elements are forced into the tube against the bias of the pressure of the bearing portions of the reed element, to the exact lengthwise position desired. In that position, as will be seen from FIG. 5, the dimensions of each reed element and of the tube are such that the reed element is in contact with the inner wall of the fillets 25 at six places, exactly positioning the reed element in five of the six possible degrees of freedom. The bearing of the bearing portions of the reed element against the fillets or the broad surfaces 21 and 22 of the inside wall of the tube holds the element against movement in the sixth degree, lengthwise translation. It also provides an exactly predetermined gap spacing between the overlapping contact sections, the maximum spacing being the difference between the effective heightwise dimension of the tube, i.e., the bearing points of the bearing portion of the contact section of the reed element on the inner wall of the tube, and the sum of the thickness of the reed elements at the contact end.

In forming the reed element of this embodiment, flat metal strip stock is bent beyond the memory of the metal from which the element is made. The reed is inserted in the tube. The glass of the tube 20 in the area of the sealing-bearing section of the reed is heated to and past the strain point of the glass above the annealing temperature but not to a watery consistency. In this condition, the wall of the glass tube against which the bearing surface of the bearing section of the reed elements does not bear will collapse as shown in FIG. 4, to seal the reed element along the sealing-bearing section 53, and at the same time, the spring of the element will cause the sealing-bearing section to move away from the reference plane of the end bearing portions, displacing the glass slightly outwardly. The heating of the glass, hence of the reed, will also tend to relax the reed element, but neither the outward movement of the reed nor the strain relief of the reed element by virtue of the heating during the sealing process will completely relieve the pressure of the end-bearing portions of the reed against the inner wall of the tube 20. The sealing of the tube 20 at spaced points, which can be accomplished simultaneously or sequentially, as explained in my U.S. Pat. No. 3,794,944, has now produced a plurality of envelopes 2, which can be separated by cutting or breaking the tube between the envelopes. Sections of the offal between successive switches can be removed to produce the kind of a switch shown in FIGS. 7 and 8, with lead sections 51 projecting at each end.

The following example of useful dimensions is given merely by way of illustration and not by way of limitation.

Kimble glass Type KG12 or Corning Type 0120 lead glass tubing of initially round cross section may be formed on a metal mandrel by well-known vacuum forming methods to the shape shown in FIG. 5. The resulting tubing may have an inside height, between surfaces 21 and 22, as viewed in FIG. 5, of 0.016 inches ±0.0001 inch and an inside width between surfaces 23 and 24 of 0.051 inches ±0.0002 inches.

Figure 1:
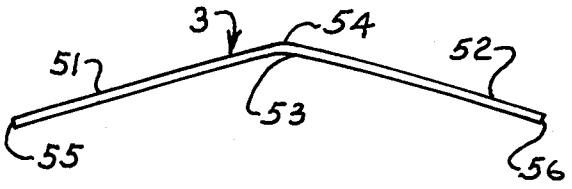
FIG. 1 is a view in side elevation, much enlarged, of one embodiment of reed element of this invention before its insertion in an envelope tube.

The inside width at the midline of surfaces 23 and 24 may be on the order of 0.0002 inches wider than the width between those surfaces at the heightwise margins of the fillets 25, and the fillets themselves may have a radius of 0.003 to 0.004 inches. The outside dimensions of the tube may be 0.040 inches by 0.070 inches ±0.001 inches, the outside dimensions not being critical. The reed elements in the embodiment shown in FIGS. 1 through 4 can have a length of 0.700 inches, a width of 0.046 inches and a thickness of 0.007 inches. The reed element is bent along a transverse line on a radius on the order of 0.007 to 0.010 inches, leaving a straight lead section and a straight contact section. In this illustrative embodiment, the lead sections and the contact sections are not of equal length. The lead section is 0.289 inches long, the sealing section is 0.188 inches long, and the contact section is 0.223 inches long. The distance from the bearing portion (edge) of the lead section to the high point of the sealing section bearing portion is 0.383 inches and the distance from the bearing portion (edge) of the contact section to the high point of the bearing portion of the sealing section is 0.317 inches. The high point of the bearing portion of the sealing section is 0.018 inches above the reference plane, as illustrated in FIG. 1, before the reed element is inserted into the tube.

It can be seen that when the reed element is inserted into the tube, the high point of the bearing portion of the sealing section will be forced toward the reference plane 0.002 inches. When the glass is softened, which for the type of glass referred to by way of example requires a heat of the magnitude of 1250°F. to 1300°F., the spring of the reed element, which may be made of any number of well-known glass sealing alloys such as Westinghouse 52, Driver-Harris 152 or Carpenter Technology 52 will displace the glass through about 0.0010 inches in a direction away from the reference plane, to produce the desired amount of residual pressure in the contact section bearing portion. The heating of the reed element will also cause some relaxation of the reed element, but not enough to relieve the pressure entirely. The contact section bearing portion bears lightly against the inside wall, but it does bear against that wall.

The reed elements 3 and 4 are positioned to overlap 0.012 inches in the tube 20. The amount of retraction of the contact ends from one another during the sealing process has been found negligible in practice.

In making a shorter reed switch, tubing of the same internal width and height can be used, but shorter reed elements for example 0.400 inches long can be used. The height of the high point of the bearing portion of the sealing section above the reference plane can still be on the order of 0.018 inches. The length of the contact section in the shorter switch can be on the order of 0.200 inches.

In making larger reed switches or switches in which greater outward displacement of the glass is used there may be a somewhat noticeable retraction of the ends of the contact sections away from one another during the sealing process, but this can easily be taken into account when the reed elements are positioned initially.

Figure 10:
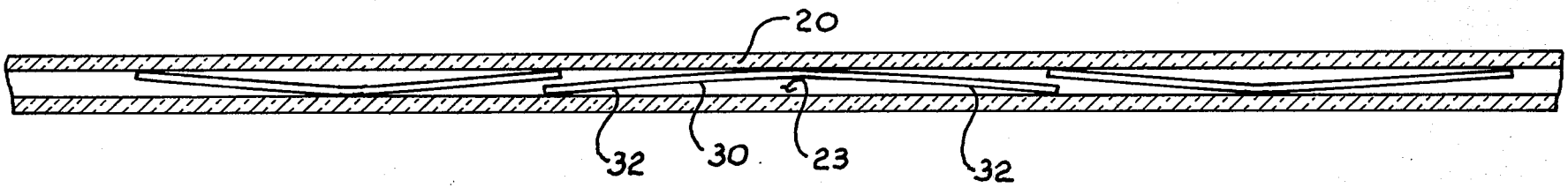
FIG. 10 is a lengthwise sectional view showing a plurality of reed elements in an envelope tube before sealing, arranged to form a single-envelope, aligned series-connected reed switch.

Referring now to FIG. 10 for another embodiment of reed switch of this invention, three reed elements are shown arranged to produce an aligned, series-connected, two-pole reed switch in a single envelope. The tube 20 in which the reed switch elements are postioned, will be sealed in the sealing areas of the three elements, and the tube at the two ends will be removed to expose the lead sections of the outer two of the three reed elements. It will be seen that in this embodiment, a center reed element 30 will have two contact sections 32, and a sealing section 23 which, for the reed element 30, should be symmetrically positioned with respect to the two contact sections 32.

It is to be observed that, contrary to the process described in my U.S. Pat. No. 3,794,944, in which the sealing section of reed elements was restrained by the bearing of rigid parts of the sealing section on unsoftened areas of the glass envelope, the present method requires that at least a portion of the sealing area of the reed element be free to move, to displace the softened glass of the envelope away from the reference plane.

The amount of displacement of the glass in the present method can be limited by the span of the softened area of the glass. However, in actual production, using tubing of the dimensions described and reed elements of the dimensions described by way of illustrative example, the control of the amount of relief to the desired magnitude has been achieved by control of the intensity and duration of the heating of the glass rather than by precise control of the length of the softened area, but either or both means of control can be used.

In the illustrative embodiment shown and described, the end-bearing portions of the lead and contact sections have been constituted by an edge. It can be seen that the ends parts of one or both of the lead and contact sections can be recurved to provide a curved or flat bearing portion, to provide either a tangential or broad flat bearing portion surface.

If spacing ribs or lands are provided in the surface 22 or surface 21 or both, the bearing portions of the reed element will bear upon those ribs or lands, rather than upon the concaves or flat inside surfaces themselves, but this will have no effect upon the method of production of the reed switches or upon their character. In this case, the effective heightwise dimension of the tube will be measured from the top of the ribs.

In lieu of the displacement of the envelope wall during the sealing process, or supplementary to it, the contact section of the reed element can be made slightly arcuate initially and then relieved, to permit the memory of the contact section to tend to restore the section to its original unbent condition, by heating the contact section in an area between the sealing-bearing section and the bearing portion of the contact section with a carefully controlled heating source such as a finely focused laser beam or an induction heater.

Numerous variations in the reed switch of this invention and the method of making it, within the scope of the appended claims, will occur to those skilled in the art in view of the foregoing disclosure. Merely by way of example, other tubing can be used instead of glass, provided the tubing is dimensionally stable and capable of being formed to the tolerances suggested by the illustrative example given. The sealing can be accomplished by other means than melting of the tube, particularly if the relaxation of the contact section is accomplished after the sealing process by means of a laser beam, for example. The reed element need not be made uniformly rectangular in cross section, although the uniformly rectangular shape has many advantages. For example, hinging notches or score lines can be provided, or a thickened section or sections, or a long-bladed spade shaped reed can be used, with a narrower lead section and standard width sealing-bearing and contact sections. In the latter construction, the bearing portion of the lead section will bear on the inner wall of the envelope at a point or at a relatively narrow area. In all of these variations, the sealing-bearing section must be out of the plane of the end bearing portions and preferably the sealing-bearing and at least one end bearing portion are dimensioned to seat as they do in the preferred embodiment described, providing at least the equivalent of a five point locating arrangement. The envelope-tube itself can be made of other non-circular configurations. For example, if a single moveable reed is used in a switch with one fixed contact, and the internal configuration of the tube is an isoceles trapezoid, the contact end must bear against the narrower of the parallel sides and the width of the sealing-bearing section of the moveable reed element should be greater than that of the end-bearing portions. In such a trapezoidal construction, there are two effective widthwise dimensions. If a tube with a hexagonal or octagonal internal configuration is used, the reed element can be uniformly wide, the effective internal width of the tube for locating purposes being the length of one side. If a flattened oval such as that illustrated in U.S. Pat. No. 3,794,944 is used, the effective width is the length of the parallel sides. A larger number of switch elements can be used to make a multi-pole series connected switch rather than the two-pole switch illustrated, and large numbers of reed elements can be positioned and sealed in a single tube to form a multiplicity of separate switches. A long, recurved, lead section, with a rib, V or dimple intermediate its ends to form the end-bearing portion can be used, a part beyond the end-bearing portion projecting from the tube during and after the sealing step, to eliminate the need for removing a part of the envelope after the sealing step. These variations are merely illustrative.

Having thus described the invention, what is claimed and desired to be secured by letters patent is:

1. The method of making a reed switch comprising forming a tube with a known effective internal heightwise dimension; forming a reed element with two end portions at least one of which is a part of a contact section and an intermediate sealing section between and entirely out of a plane defined by said end portions, a bearing surface of said sealing section being displaced from said plane a distance greater than said effective internal heightwise dimension of said tube; inserting said reed element into an open end of said tube sufficiently far to cause both of said end portions and said sealing section bearing surface to bear against the inside wall of said tube, the contact section end portion of said reed element bearing with a force greater than the force ultimately to be exerted by said portion in the finished switch; sealing said sealing portion in said tube and relieving at least a part of the pressure exerted by the said contact section end portion of the said reed element.

2. The method of claim 1 wherein the pressure is relieved as the reed element is sealed in said tube.

3. The method of claim 2 wherein at least a part of the tube surrounding an outer end portion of the reed element is removed subsequent to the sealing step.

4. The method of claim 2 wherein the tube is glass, the sealing step is accomplished by softening said glass through at least the full initial bearing area of the sealing section of the reed element, and the glass is softened sufficiently to yield to the pressure of said bearing area of said sealing section.

5. The method of claim 1 wherein the said force is relieved subsequent to the sealing step.

6. The method of claim 5 wherein the relief is accomplished by heating an area of the reed element between the sealing section and the contact section end portion.

7. The method of making a reed switch comprising forming a glass tube of substantially uniform, non-circular internal cross sectional configuration with precisely predetermined effective internal heightwise and widthwise dimensions and having at least one open end; forming an elongated reed element with an end-bearing portion at both ends, at least one of said ends being a contact section, said reed element ends having a maximum width to fit slidably but closely within said effective widthwise internal dimension of said tube, of a thickness less than half the effective heightwise internal dimension of said tube and of a length less than the length of said tube; bending said reed element intermediate its said ends beyond the memory of said reed element to form a sealing-bearing section displaced entirely from a reference plane defined by said end-bearing portions an amount to make the distance between the said reference plane and the farthest surface of said sealing-bearing section greater than the said effective heightwise internal dimension of the tube, said sealing-bearing section having a maximum width to fit slidably but closely within said effective widthwise dimension of said tube; forcing said reed element into said tube until both said end-bearing portions and said farthest surface of said sealing-bearing section bear upon the internal surface of said tube; softening the glass of said tube in the area of said sealing-bearing section of the reed element while maintaining the glass in the area of the end-bearing portions unsoftened to seal at least a part of said sealing bearing-section in said tube and to permit the said sealing-bearing section to move a part of said softened tube away from the said reference plane and to relieve at least part of the bearing force of the contact section end-bearing portion of the reed element, said reed element and tube constituting the sole means for positioning the reed element and tube with respect to one another during the sealing and relieving process.

8. The method of making a reed switch comprising forming a glass tube substantially rectangular in cross section and of uniform effective heightwise and widthwise dimensions throughout an envelope-forming length of said tube and having at least one open end; forming an elongate reed element of uniform cross section throughout its length with two end portions, at least one of which is a part of a contact section and an intermediate sealing section between and entirely out of a reference plane defined by said end portions, a bearing surface of said sealing section being displaced from said plane a distance greater than said effective internal heightwise dimension of said tube, said reed element being of a width to fit slidably but closely within the effective widthwise dimension of said tube; inserting said reed element into said open end of said tube sufficiently far to cause both of said end portions and said sealing section bearing surface to bear against the inside wall of said tube, the contact section end portion of said reed element bearing with a force greater than the force ultimately to be exerted by said portion in the finished switch; heating the full circumference of said tube through at least the full initial bearing area of said sealing section of the reed element to soften the glass of said tube in said area to cause said tube to collapse against and seal to said reed element sealing section and to cause the said sealing section to move away from said reference plane against the bias of said softened glass to relieve at least a part of the bearing pressure of said end-bearing portions on said tube wall, the tube wall at the said end-bearing portions being unsoftened, and thereafter cooling said glass, the said reed element and tube constituting the sole means for positioning the reed element and tube with respect to one another during said sealing and relieving process.

9. A reed switch comprising an envelope having a sealed, contact-containing section, and an elongated reed having, in succession, a lead section having an end-bearing portion, a sealing-bearing section, and a contact section having an end-bearing portion, all within said envelope, said lead and contact-bearing portions bearing upon undistorted parts of the inside wall of said envelope, at least a part of said sealing-bearing portion being sealed in and to said envelope, and said lead section extending in a direction from said sealed-in part of said sealing-bearing portion away from said sealed, contact-containing section of said envelope.

10. The reed switch of claim 9 wherein the lead and contact section end-bearing portions of the reed element define a plane and said sealing-bearing portion lies out of said plane.

11. In a reed switch having a fusible glass envelope, non-circular in cross section, and reed elements sealed in opposite ends of said envelope, each of said reed elements having a lead section, a contact section and an intermediate sealing-bearing section, the improvement comprising said lead section and said contact section having end-bearing portions bearing upon undistorted parts of the inner wall of said envelope and defining a reference plane and at least a part of said sealing-bearing section being sealed in and fused to the glass of the wall of said envelope and extending in a distorted part of said wall a distance from said reference plane greater than the distance from said reference plane to the undistorted part of said wall immediately adjacent said distorted part.

12. The improvement of claim 11 wherein the said end-bearing portions of the reed element are of a width closely to fit an effective widthwise dimension of the envelope at the undistorted part upon which they bear, the intermediate sealing bearing section is of a width closely to fit an effective widthwise dimension of the undistorted part of said envelope adjacent the distorted part, and said reed elements and tube constitute the sole locating and positioning means with respect to one another in all six possible degrees of freedom when the reed elements are being sealed in the said envelope.

* * * * *